US010223970B2

(12) United States Patent
Kim

(10) Patent No.: US 10,223,970 B2
(45) Date of Patent: Mar. 5, 2019

(54) PIXEL, RELATED OPERATING METHOD, AND RELATED DISPLAY DEVICE

(71) Applicant: Samsung Display Co., Ltd., Yongin-si, Gyeonggi-Do (KR)

(72) Inventor: Dong-Hwi Kim, Asan-si (KR)

(73) Assignee: Samsung Display Co., Ltd. (KR)

( * ) Notice: Subject to any disclaimer, the term of this patent is extended or adjusted under 35 U.S.C. 154(b) by 29 days.

(21) Appl. No.: 15/379,148

(22) Filed: Dec. 14, 2016

(65) Prior Publication Data

US 2017/0186374 A1 Jun. 29, 2017

(30) Foreign Application Priority Data

Dec. 29, 2015 (KR) ..... 10-2015-0188060

(51) Int. Cl.
*G09G 3/3258* (2016.01)

(52) U.S. Cl.
CPC ..... *G09G 3/3258* (2013.01); *G09G 2300/043* (2013.01); *G09G 2300/0426* (2013.01); *G09G 2300/0809* (2013.01); *G09G 2330/028* (2013.01)

(58) Field of Classification Search
CPC ..... G09G 3/30–3/3291
See application file for complete search history.

(56) References Cited

U.S. PATENT DOCUMENTS 7,683,004 B2 3/2010 Feldman et al.
9,786,723 B2 * 10/2017 Yang ..... H01L 27/323
9,837,022 B2 * 12/2017 Lee ..... G09G 3/3258
9,842,537 B2 * 12/2017 Lim ..... G09G 3/3225
9,898,970 B2 * 2/2018 Kang ..... G09G 3/3291
9,911,384 B2 * 3/2018 Park ..... G09G 3/3266
2011/0080395 A1 * 4/2011 Chung ..... G09G 3/3233 345/211
2015/0097762 A1 * 4/2015 Kim ..... G09G 3/3225 345/76

FOREIGN PATENT DOCUMENTS

KR 10-0624137 B1 9/2006
KR 10-2007-0019463 A 2/2007

* cited by examiner

*Primary Examiner* — Hang Lin
(74) *Attorney, Agent, or Firm* — Innovation Counsel LLP

(57) ABSTRACT

A pixel may include a light emitting element, a first power supply terminal set, an initialization terminal, a capacitor, a first transistor, a second transistor, a third transistor, a fourth transistor, a fifth transistor, and a sixth transistor. The first power supply terminal set is electrically connected through no intervening transistor to each of the fourth transistor and the sixth transistor. The capacitor is electrically connected through no intervening transistor to each of the initialization terminal and the third transistor. Each of the first transistor and the fourth transistor is electrically connected through no intervening transistor to the second transistor. Each of the second transistor and the third transistor is electrically connected through no intervening transistor to the fifth transistor. Each of the fifth transistor and the sixth transistor is electrically through no intervening transistor to the light emitting element.

20 Claims, 12 Drawing Sheets

PIXEL, RELATED OPERATING METHOD, AND RELATED DISPLAY DEVICE

CROSS-REFERENCE TO RELATED APPLICATION(S)

This application claims priority under 35 USC § 119 to Korean Patent Application No. 10-2015-0188060, filed on Dec. 29, 2015 in the Korean Intellectual Property Office (KIPO); the contents of the Korean Patent Application are incorporated herein by reference.

BACKGROUND

1. Technical Field

The technical field is related to a pixel, a method of operating the pixel, and a display device that includes the pixel.

2. Description of the Related Art

A pixel of a display device may include a plurality of transistors and wirings for data writing, driving, threshold voltage compensation, emission control, driving transistor initialization, initialization, storage capacitor initialization, etc. Requirements associated with the transistors and wirings may limit miniaturization of the pixel and/or may limit resolution of a display device that includes the pixel.

SUMMARY

Some example embodiments may be related to a pixel of a display device, e.g., an organic light emitting diode (OLED) display device, having a small size.

Some example embodiments may be related to a display device, e.g., an OLED display device, having a small size and/or high resolution.

Some example embodiments may be related to a pixel. The pixel may include a light emitting element, a first power supply terminal set, an initialization terminal, a capacitor, a first transistor, a second transistor, a third transistor, a fourth transistor, a fifth transistor, and a sixth transistor. The first power supply terminal may include one or more supply terminals and may receive a first power supply voltage. The initialization terminal may be electrically insulated from the first power supply terminal set and may receive an initialization voltage. The first power supply terminal set may be electrically connected through no intervening transistor to each of the fourth transistor and the sixth transistor. The capacitor may be electrically connected through no intervening transistor to each of the initialization terminal and the third transistor. Each of the first transistor and the fourth transistor may be electrically connected through no intervening transistor to the second transistor. Each of the second transistor and the third transistor may be electrically connected through no intervening transistor to the fifth transistor. Each of the fifth transistor and the sixth transistor may be electrically through no intervening transistor to the light emitting element.

Electrical connections may be further enabled when transistors are turned on. A data line (e.g., a data line of a display device that includes the pixel) may be electrically connected through the first transistor to the second transistor. The first power supply terminal set may be electrically connected through the fourth transistor to the second transistor. Each of the first transistor and the fourth transistor may be electrically connected through the second transistor to the fifth transistor. Each of the second transistor and the third transistor may be electrically connected through the fifth transistor to the light emitting element. The initialization terminal may be electrically connected through the capacitor without any intervening transistor to the third transistor. The capacitor may be electrically connected through the third transistor to the fifth transistor. The first power supply terminal set may be electrically connected through the sixth transistor with no other intervening transistor to the light emitting device.

The capacitor may be electrically insulated from the first power supply terminal set.

The capacitor may be electrically connected through no intervening transistor to a drain terminal of the third transistor or a source terminal of the third transistor. The initialization terminal may be electrically connected through the capacitor and no intervening transistor to a drain terminal of the third transistor or a source terminal of the third transistor.

The capacitor may be electrically connected through no intervening transistor to a gate terminal of the second transistor. The initialization terminal may be electrically connected through the capacitor and no intervening transistor to a gate terminal of the second transistor.

A source terminal of the sixth transistor may be electrically connected through no intervening transistor to a source terminal of the fourth transistor.

The first power supply terminal set may be electrically connected through no intervening transistor to each of a source terminal of the sixth transistor and a source terminal of the fourth transistor.

The first power supply terminal set may include a first supply terminal and a second supply terminal. The first supply terminal may receive the first power supply voltage and may be electrically connected through no intervening transistor to a source terminal of the sixth transistor. The second supply terminal may receive the first power supply voltage and may be electrically connected through no intervening transistor to a source terminal of the fourth transistor.

The first power supply terminal set may be electrically connected through the sixth transistor, subsequently the fifth transistor, and subsequently the third transistor with no other intervening transistor to a gate terminal of the second transistor.

The pixel may include: a first power supply wire section that may transmit the first power supply voltage. The fourth transistor may include a first contact portion. The first contact portion may directly contact the first power supply terminal set or the first power supply wire section. The fifth transistor may include a second contact portion. The second contact portion may directly contact the light emitting element. A center point of first contact portion may be aligned with a center point of the second contact portion in a direction that is inclined (i.e., at an acute angle) with respect to the first power supply wire section.

Some example embodiments may be related to a display device. The display device may include a data line for transmitting a data voltage, a scan line for transmitting a scan signal, and a pixel. The pixel may include a light emitting element, a first power supply terminal set, a first transistor, a second transistor, a third transistor, a fourth transistor, a fifth transistor, and a sixth transistor. The data line may be electrically connected through no intervening transistor to the first transistor. The scan line may be electrically connected through no intervening transistor to each of a gate terminal of the first transistor, a gate terminal of the third transistor, and a gate terminal of the sixth transistor. The first power supply terminal set may receive a first power supply voltage and may be electrically connected through no intervening transistor to each of the fourth transistor and the sixth transistor. Each of the first transistor and the fourth transistor may be electrically connected through no intervening transistor to the second transistor. Each of the second transistor and the third transistor may be electrically connected through no intervening transistor to the fifth transistor. Each of the fifth transistor and the sixth transistor may be electrically connected through no intervening transistor to the light emitting element.

The pixel may include an initialization terminal and a capacitor. The initialization terminal may be electrically insulated from the first power supply terminal set, may receive an initialization voltage, and may be electrically connected through no intervening transistor to a first electrode of the capacitor. A second electrode of the capacitor may be electrically connected through no intervening transistor to a gate terminal of the second transistor.

The first power supply terminal set may be electrically connected through the sixth transistor, subsequently the fifth transistor, and subsequently the third transistor with no other intervening transistor to a gate terminal of the second transistor.

Some example embodiments may be related to a method of operating a pixel. The pixel may include a light emitting element, a first transistor, a second transistor, a third transistor, a fourth transistor, a fifth transistor, and a sixth transistor. The method may include, in an initialization period, providing a first power supply voltage through the sixth transistor, subsequently the fifth transistor, and subsequently the third transistor to a gate terminal of the second transistor. Each of the first transistor and the fourth transistor may be electrically connected through no intervening transistor to the second transistor. Each of the second transistor and the third transistor may be electrically connected through no intervening transistor to the fifth transistor. Each of the fifth transistor and the sixth transistor may be electrically connected through no intervening transistor to the light emitting element.

The method may include, in the initialization period, providing the first power supply voltage through the sixth transistor to an anode of the light emitting element. The method may include, in the initialization period, providing a second power supply voltage to a cathode of the light emitting element. The second power supply voltage may be higher than or equal to the first power supply voltage.

The method may include, in the initialization period, providing an initialization voltage to a first electrode of a capacitor. A second electrode of the capacitor may be electrically connected through no intervening transistor to the gate terminal of the second transistor. The method may include, after the initialization period, providing an after-initialization voltage to the first electrode of the capacitor. The after-initialization voltage may be lower than the initialization voltage.

The method may include, in the initialization period, providing the first power supply voltage through no capacitor part to the second electrode of the capacitor.

The method may include, in the initialization period, providing the first power supply voltage through the sixth transistor, subsequently the fifth transistor, and subsequently the third transistor to the second electrode of the capacitor.

The method may include, after the initialization period, turning off both the third transistor and the sixth transistor.

The method may include, in an initialization period, providing the first power supply voltage to both the gate terminal of the second transistor and a source terminal of the fourth transistor.

In a pixel of a display device, e.g., an OLED display device, according to example embodiments, a driving transistor is initialized using an anode initialization transistor, an emission control transistor, and a threshold voltage compensation transistor without requiring a gate initialization transistor connected between the gate of the driving transistor and an initialization voltage source. Accordingly, the pixel according to example embodiments may have a small size, and the display device may have high resolution.

In a display device, e.g., an OLED display device, according to example embodiments, an initialization operation is performed using a scan signal and an emission control signal without requiring an initialization control signal. Therefore, satisfactory resolution of the display device may be attained.

In a display device, e.g., an OLED display device according to example embodiments, an initialization operation is performed using a power supply voltage without requiring an initialization voltage. Therefore, satisfactory resolution of the display device may be attained.

DESCRIPTION OF EMBODIMENTS

Figure 1:
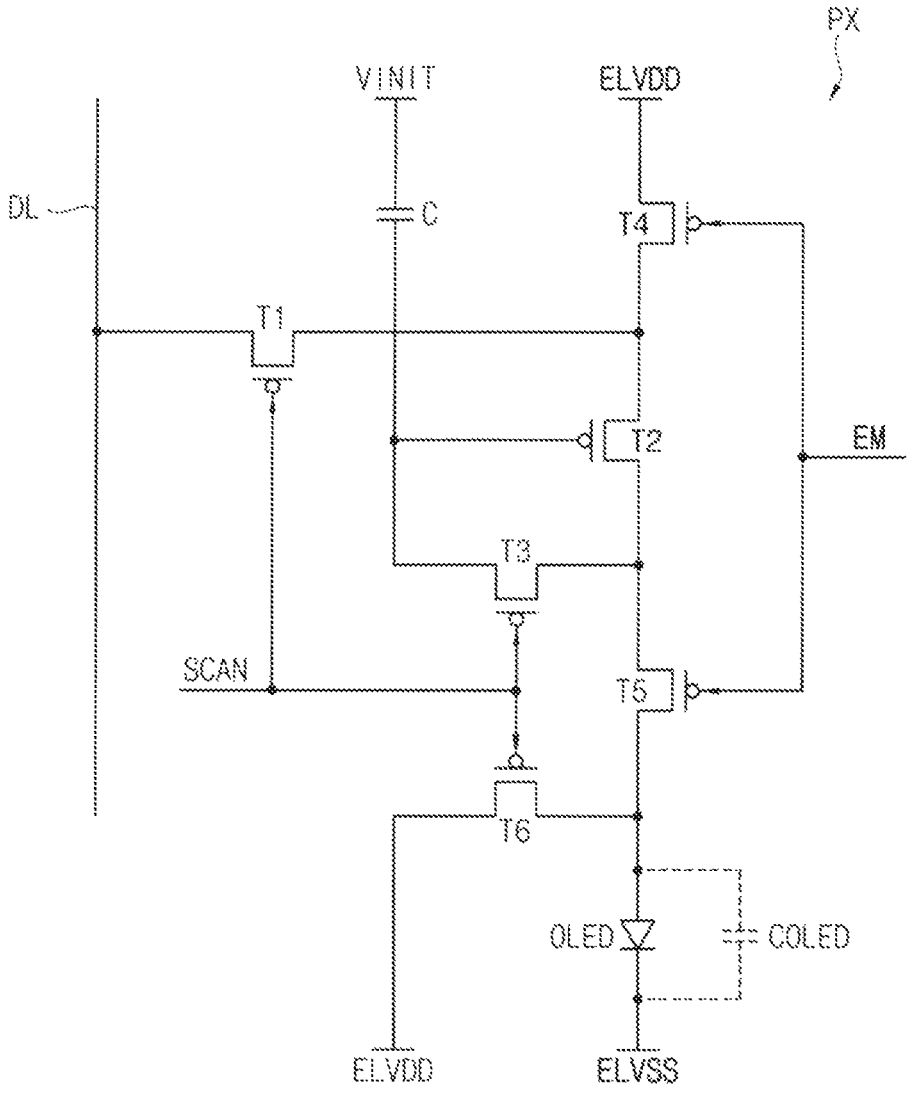
FIG. 1 is a circuit diagram illustrating a pixel of a display device, e.g., an organic light emitting diode (OLED) display device, according to example embodiments.

Example embodiments are described with reference to the accompanying drawings. Like or similar reference numerals may refer to like or similar elements throughout. Although the terms "first", "second", etc. may be used herein to describe various elements, these elements, should not be limited by these terms. These terms may be used to distinguish one element from another element. Thus, a first element discussed below may be termed a second element without departing from the teachings of the present invention. The description of an element as a "first" element may not require or imply the presence of a second element or other elements. The terms "first", "second", etc. may also be used herein to differentiate different categories or sets of elements. For conciseness, the terms "first", "second", etc.

may represent "first-category (or first-set)", "second-category (or second-set)", etc., respectively. The term "connect" may mean "electrically connect", "directly connect", or "indirectly connect". The term "insulate" may mean "electrically insulate". The term "conductive" may mean "electrically conductive". The term "electrically connected" may mean "electrically connected without any intervening transistors". If a component (e.g., a transistor) is described as connected between a first element and a second element, then a source/drain/input/output terminal of the component may be electrically connected to the first element through no intervening transistors, and a drain/source/output/input terminal of the component may be electrically connected to the second element through no intervening transistors.

FIG. 1 is a circuit diagram illustrating a pixel of a display device, e.g., an organic light emitting diode (OLED) display device, according to example embodiments.

Referring to FIG. 1, a pixel PX of an OLED display device may include a first transistor T1 having a first terminal connected to a data line DL, a second terminal, and a gate for receiving a scan signal SCAN, a second transistor T2 having a first terminal connected to the second terminal of the first transistor T1, a second terminal, and a gate, a capacitor C having a first electrode connected to an initialization terminal for receiving an initialization voltage VINIT, and a second electrode connected to the gate of the second transistor T2, a third transistor T3 having a first terminal connected to the second terminal of the second transistor T2, a second terminal connected to the gate of the second transistor T2, and a gate for receiving the scan signal SCAN, a fourth transistor T4 having a first terminal connected to a first power supply terminal set for receiving a first power supply voltage ELVDD, a second terminal connected to the first terminal of the second transistor T2, and a gate for receiving an emission control signal EM, a fifth transistor T5 having a first terminal connected to the second terminal of the second transistor, a second terminal, and a gate for receiving the emission control signal EM, a light emitting element (e.g., an organic light emitting diode OLED) having an anode connected to the second terminal of the fifth transistor T5, and a cathode connected to a second power supply terminal for receiving a second power supply voltage ELVSS, and a sixth transistor T6 having a first terminal connected to the anode of the OLED, a second terminal connected to the first power supply terminal set for receiving the first power supply voltage ELVDD, and a gate for receiving the scan signal SCAN.

The first transistor T1 may be a scan transistor that is turned on in response to the scan signal SCAN and transfer a voltage (e.g., a data voltage) provided to the data line DL to the first terminal of the second transistor T2. The first transistor T1 may be turned on not only during a data writing period when the data voltage is stored in the pixel PX, but also during an initialization period when the second transistor T2, the capacitor C and/or the OLED are initialized.

The second transistor T2 may be a driving transistor that drives the OLED based on a voltage stored in the capacitor C. During the initialization period, the second transistor T2 may be initialized in an off-bias state where the second transistor T2 has a gate-source voltage of about 0 V. Further, in some example embodiments, while the second transistor T2 is initialized in the off-bias state, the second transistor T2 may have a drain-source voltage of about 0 V.

The third transistor T3 may be a threshold voltage compensation transistor that is turned on in response to the scan signal SCAN and allows the second transistor T2 to be diode-connected. The third transistor T3 may be turned on not only during the data writing period, but also during the initialization period.

The data voltage provided to the data line DL may be transferred to the capacitor C through the first transistor T1 and the diode-connected second transistor T2. Since the data voltage is transferred through the diode-connected second transistor T2, a voltage corresponding to an absolute value of a threshold voltage of the second transistor T2 subtracted from the data voltage may be stored in the capacitor C. Thus, a threshold voltage deviation between the second transistors T2 of a plurality of pixels PX included in the OLED display device may be compensated. During the initialization period, the initialization voltage VINIT having a high level may be applied to the first electrode of the capacitor C, and the first power supply voltage ELVDD may be applied to the second electrode of the capacitor C. Accordingly, the capacitor C may be initialized based on the initialization voltage VINIT having the high level and the first power supply voltage ELVDD. After the initialization period, the initialization voltage VINIT connected to the first electrode of the capacitor C may be decreased from the high level to a low level, and thus a voltage of the second electrode of the capacitor C (or a voltage of the gate of the second transistor T2) may be decreased to a voltage that is sufficiently low (e.g., lower than the voltage corresponding to the absolute value of the threshold voltage subtracted from the data voltage) to write the data voltage.

The fourth transistor T4 may connect the first power supply voltage ELVDD and the second transistor T2 in response to the emission control signal EM, and the fifth transistor T5 may connect the second transistor T2 and the OLED in response to the emission control signal EM. The fourth and fifth transistors T4 and T5 may be emission control transistors that control light-emission of the OLED in response to the emission control signal EM. During an emission period, the fourth and fifth transistors T4 and T5 may be turned on, and thus a current path from the first power supply voltage ELVDD through the second transistor T2 and the OLED to the second power supply voltage ELVSS may be formed. The fourth and fifth transistors T4 and T5 may be turned on not only during the emission period, but also during the initialization period.

The OLED may emit light in response to a driving current that is generated by the second transistor T2 based on the voltage stored in the capacitor C. During the initialization period (and/or the data writing period), the first power supply voltage ELVDD may be applied to the anode of the OLED through the sixth transistor T6, and the OLED may be initialized based on the first power supply voltage ELVDD. For example, during the initialization period (and/or the data writing period), the second power supply voltage ELVSS connected to the cathode of the OLED may have a voltage level higher than or equal to a voltage level of the first power supply voltage ELVDD, the OLED may not emit light, and a parasitic capacitor COLED may be discharged.

The sixth transistor T6 may be an anode initialization transistor that is turned on in response to the scan signal SCAN and transfers the first power supply voltage ELVDD to the anode of the OLED. The turned-on sixth transistor T6 may further transfer the first power supply voltage ELVDD to the second terminal of the fifth transistor T5.

During the initialization period, the third the third transistor T3 and the sixth transistor T6 may be turned on in response to the scan signal SCAN, and the fifth transistor T5 may be turned on in response to the emission control signal EM. Accordingly, during the initialization period, the first power supply voltage ELVDD may be applied to the gate of the second transistor T2 through the turned-on sixth transistor T6, the turned-on fifth transistor T5 and the turned-on third transistor T3, and thus the second transistor T2 may be initialized in the off-bias state where the second transistor T2 has the gate-source voltage of about 0 V. Since the second transistors T2 of the pixels included in the OLED display device are initialized, regardless of operating states of the second transistors T2 in a previous image frame, the second transistors T2 of all pixels included in the OLED display device may have substantially the same response characteristic. That is, a hysteresis of the second transistor T2 may be removed. Further, since the second transistor T2 is initialized in the off-bias state, stress applied to the second transistor T2 may be reduced compared with a case where the second transistor T2 is initialized in an on-bias state, and thus degradation of the second transistor T2 may be reduced.

In an OLED display device, to initialize a driving transistor, each pixel of the OLED display device may include a gate initialization transistor that applies an initialization voltage to a gate of the driving transistor. However, a pixel PX of an OLED display device according to example embodiments may not include the gate initialization transistor for applying the initialization voltage to the gate of the second transistor T2. Accordingly, the pixel PX of the OLED display device according to example embodiments may have a small size. In an OLED display device, an initialization voltage may be used to initialize the driving transistor. However, a pixel PX of an OLED display device according to example embodiments may use a first power supply voltage ELVDD instead of an initialization voltage to initialize the second transistor T2. Accordingly, the OLED display device according to example embodiments may have a reduced number of wirings. In an OLED display device, an initialization control signal may be used to control the gate initialization transistor. However, an OLED display device according to example embodiments may perform an initialization operation using a scan signal SCAN and an emission control signal EM without requiring an initialization control signal, and thus a number of wirings included in the OLED display device according to example embodiments may be minimized. Therefore, a pixel PX of an OLED display device according to example embodiments may have a small size, and an OLED display device according to example embodiments may have high resolution and/or a high value of pixels per inch (PPI).

An example of an operation method of the pixel PX of the OLED display device according to example embodiments is described with reference to FIGS. 2 through 4.

Figure 2:
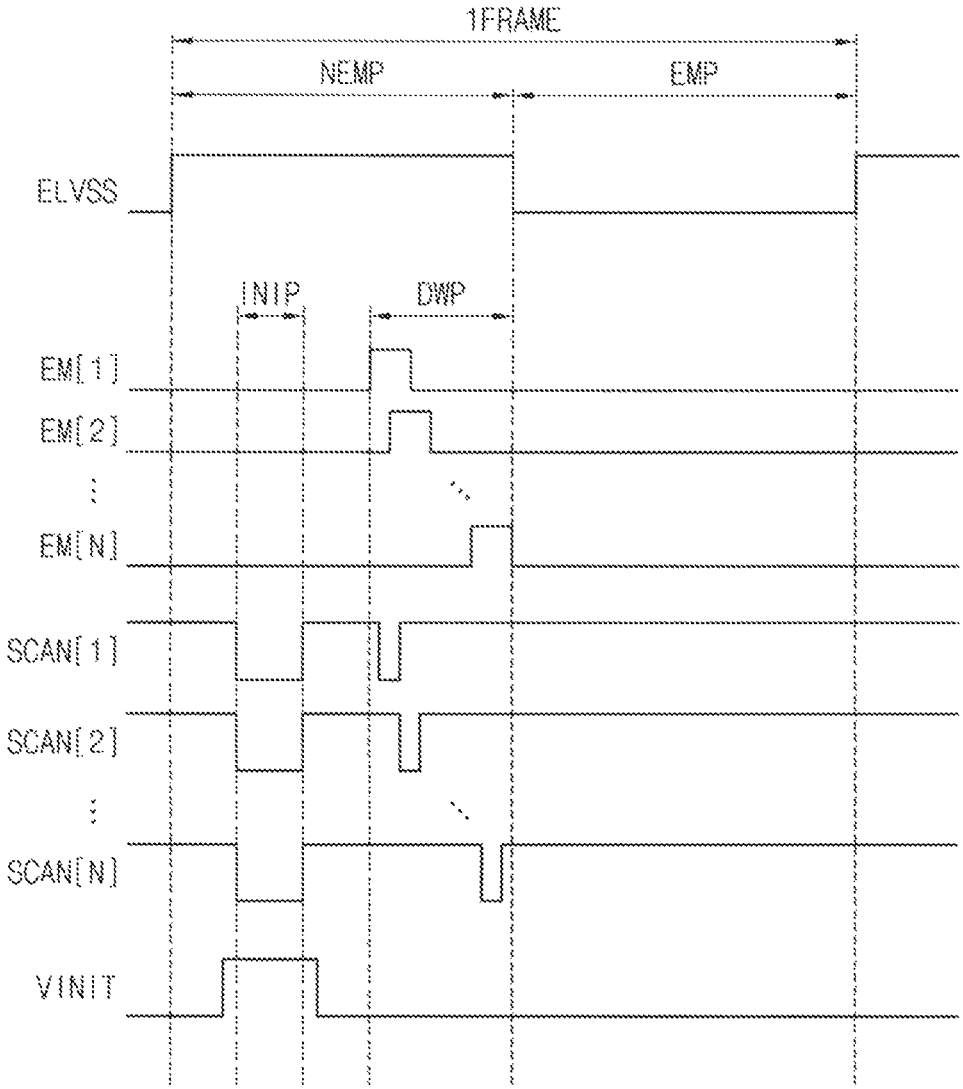
FIG. 2 is a timing diagram for illustrating an operation method of a pixel of a display device, e.g., an OLED display device, according to example embodiments.
Figure 3A:
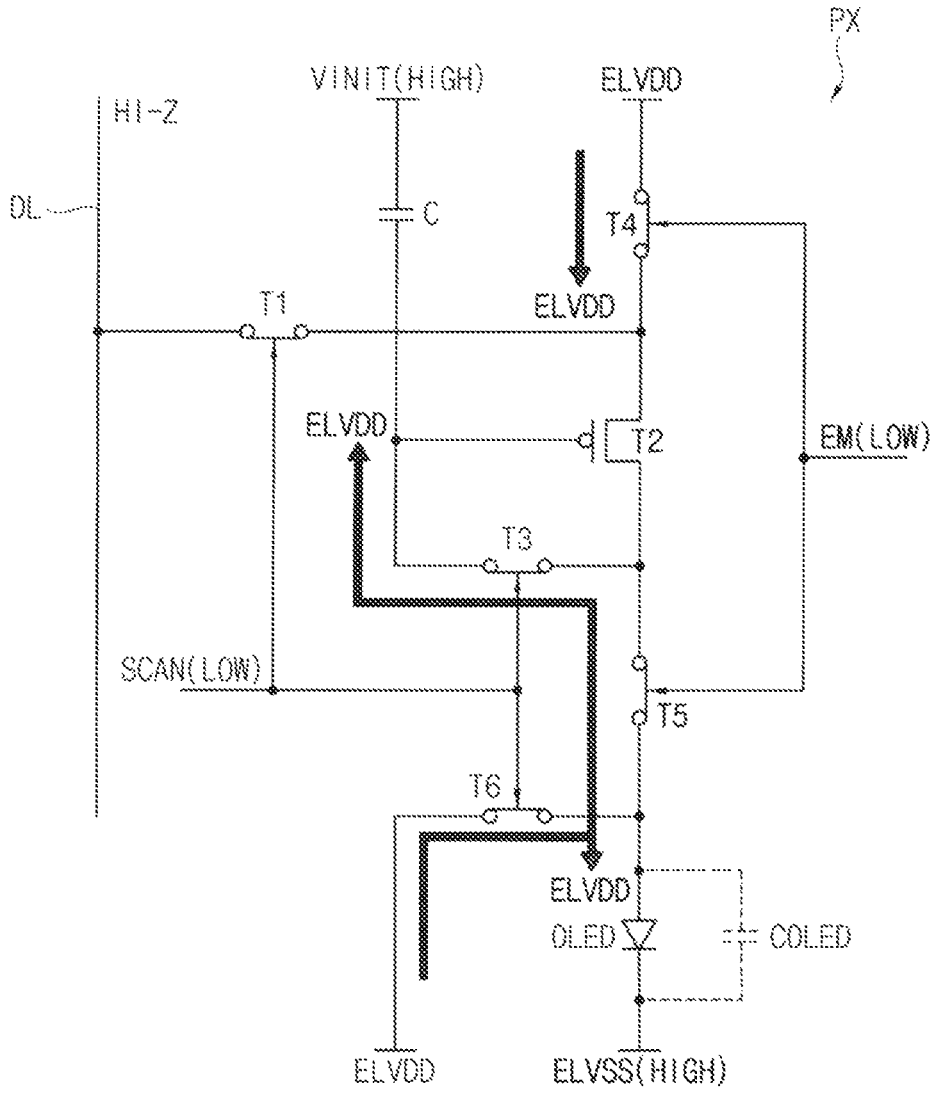
FIG. 3A, FIG. 3B, FIG. 3C, and FIG. 3D are circuit diagrams for illustrating an operation method of a pixel of a display device, e.g., an OLED display device, according to example embodiments.
Figure 3B:
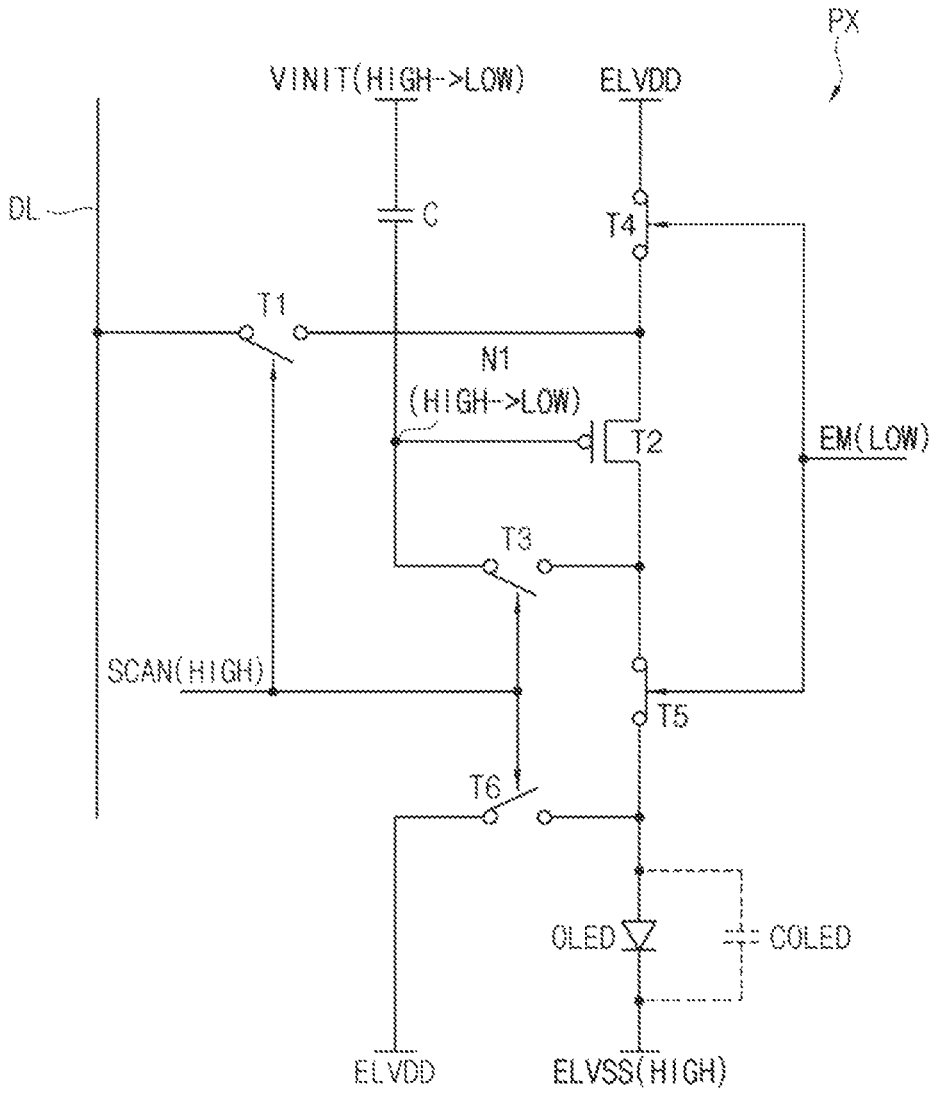
Figure 3C:
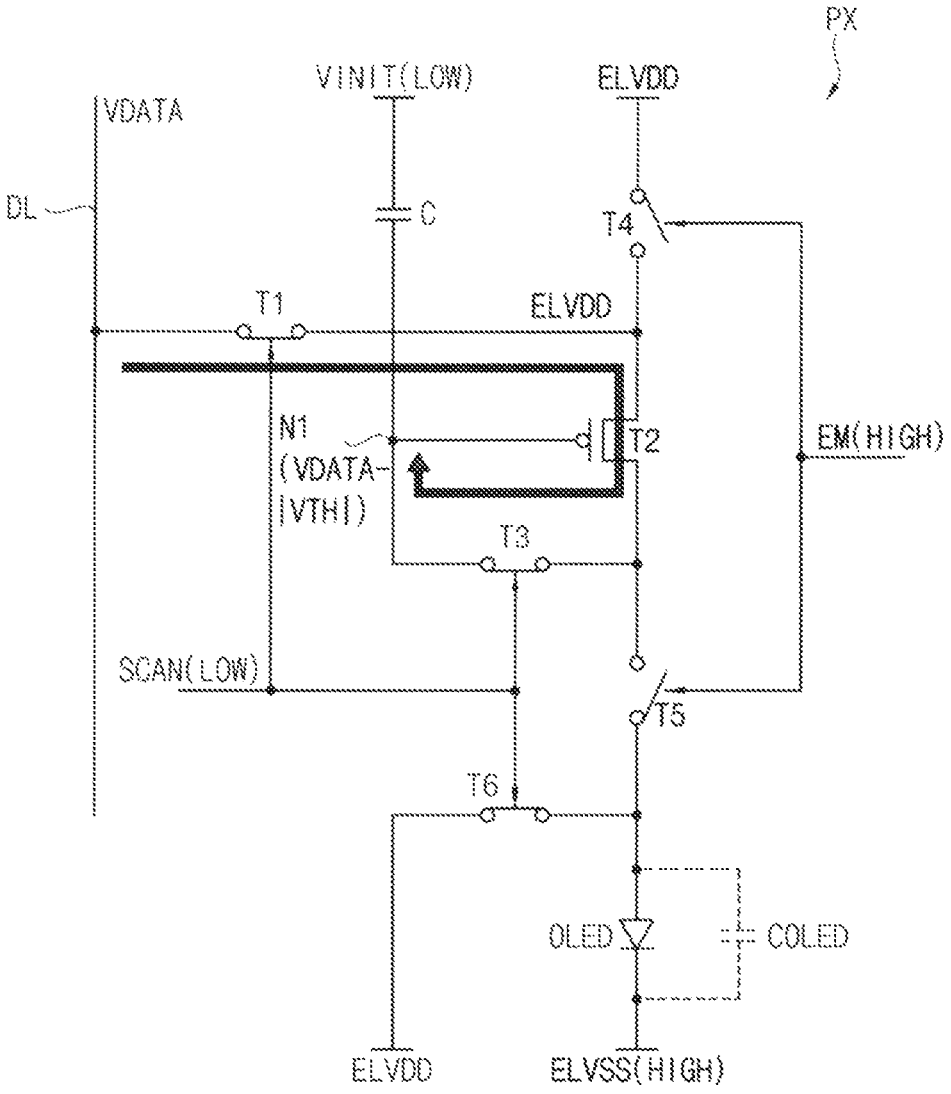
Figure 3D:
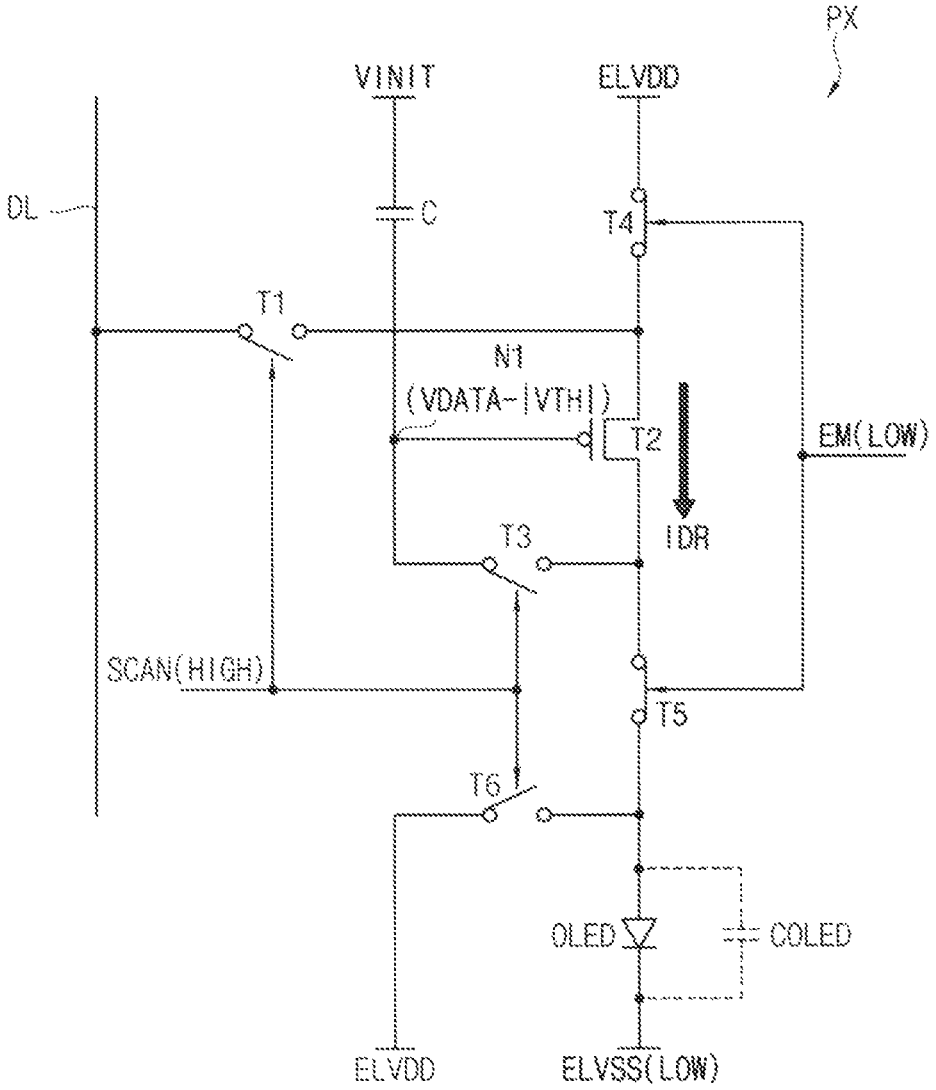
Figure 4:
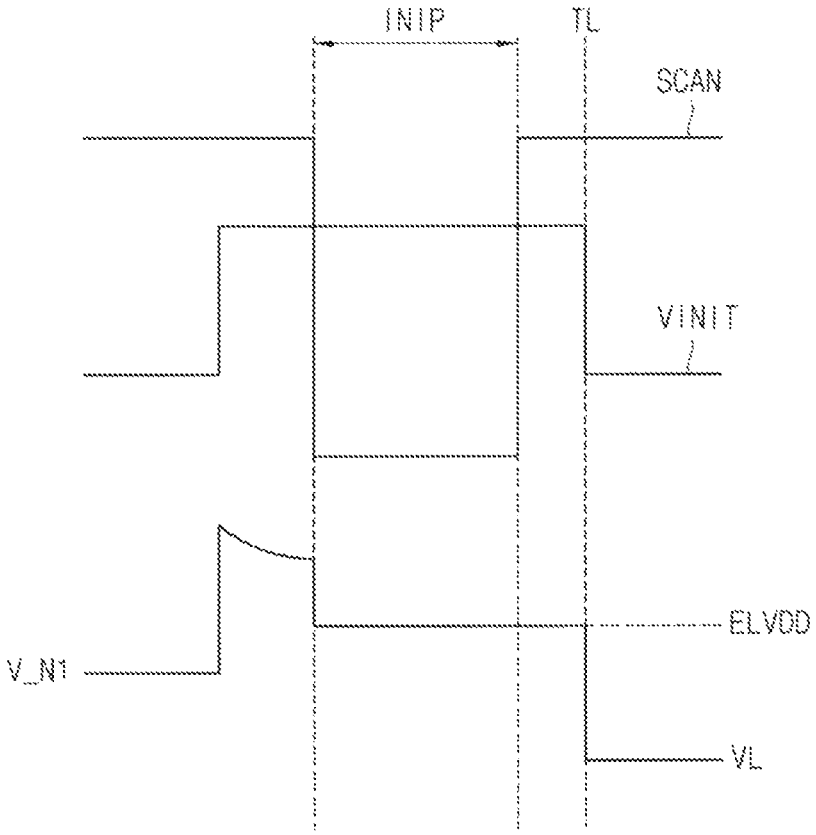
FIG. 4 is a timing diagram illustrating a voltage at a gate terminal of a transistor of a pixel (e.g., a second transistor of the pixel illustrated in FIG. 1) before, during, and after an initialization period.

FIG. 2 is a timing diagram for illustrating an operation method of a pixel of an OLED display device according to example embodiments, FIGS. 3A through 3D are circuit diagrams for illustrating an operation method of a pixel of an OLED display device according to example embodiments, and FIG. 4 is a timing diagram illustrating a voltage at a gate terminal of a transistor of a pixel (e.g., a second transistor of the pixel illustrated in FIG. 1) before, during, and after an initialization period.

Referring to FIGS. 1 and 2, one frame (or one image frame) may be divided into a non-emission period NEMP and an emission period EMP, the non-emission period NEMP and the emission period EMP may be determined or distinguished by a voltage level of the second power supply voltage ELVSS. The non-emission period NEMP may be a period during which the second power supply voltage ELVSS has a high level, and the emission period EMP may be a period during which the second power supply voltage ELVSS has a low level. In some example embodiments, the second power supply voltage ELVSS may have a voltage level higher than or equal to a voltage level of the first power supply voltage ELVDD before the emission period EMP, may have a voltage level lower than the voltage level of the first power supply voltage ELVDD during the emission period EMP, and may again have the voltage level higher than or equal to the voltage level of the first power supply voltage ELVDD after the emission period EMP. For example, the second power supply voltage ELVSS may have the voltage level higher than or equal to the voltage level of the first power supply voltage ELVDD during the non-emission period NEMP, and thus a current path from the first power supply voltage ELVDD to the second power supply voltage ELVSS may not be formed. Further, the second power supply voltage ELVSS may have the voltage level lower than the voltage level of the first power supply voltage ELVDD during the emission period EMP, and thus the current path from the first power supply voltage ELVDD to the second power supply voltage ELVSS may be formed.

The initialization voltage INIT may be increased to a high level (i.e., an initialization level/voltage) before the initialization period INIP or at a start time point of the initialization period INIP, and may be maintained as the high level during the initialization period INIP. During the initialization period INIP, the scan signals SCAN[1], SCAN[2] and SCAN[N] and the emission control signals EM[1], EM[2] and EM[N] for all pixels included in the OLED display device may have a low level, and the second transistors T2, the capacitors C and/or the OLEDS of the all pixels may be substantially simultaneously initialized. That is, during the initialization period INIP, the scan signals SCAN[1], SCAN [2] and SCAN[N] and the emission control signals EM[1], EM[2] and EM[N] may be substantially simultaneously to the all pixels, and the initialization operation for the all pixels may be substantially simultaneously performed.

As illustrated in FIG. 3A, during the initialization period INIP, the third transistor T3 and the sixth transistor T6 may be turned on in response to the scan signal SCAN, and the fifth transistor T5 may be turned on in response to the emission control signal EM. Accordingly, during the initialization period INIP, the first power supply voltage ELVDD may be applied to the gate of the second transistor T2 through the turned-on sixth transistor T6, the turned-on fifth transistor T5 and the turned-on third transistor T3, and thus the second transistor T2 may be initialized based on the first power supply voltage ELVDD applied to the gate of the second transistor T2. Further, the first power supply voltage ELVDD may be applied to the first terminal of the second transistor T2 through the turned-on fourth transistor T4, and also applied to the second terminal of the second transistor T2 through the turned-on sixth transistor T6 and the turned-on fifth transistor T5. Accordingly, the second transistor T2 may be initialized in the off-bias state where the second transistor T2 has the gate-source voltage of about 0 V and the drain-source voltage of about 0 V. Although the first transistor T1 is turned on in response to the scan signal SCAN, since the data line DL may have a high impedance state HI-Z or the first power supply voltage ELVDD may be applied to the data line DL, the data line DL may not affect a voltage of the first terminal of the driving transistor T2.

Further, during the initialization period INIP, the initialization voltage VINIT having the high level may be applied to the first electrode of the capacitor C, and the first power supply voltage ELVDD may be applied to the second electrode of the capacitor C through the turned-on sixth transistor T6, the turned-on fifth transistor T5 and the turned-on third transistor T3. Accordingly, during the initialization period INIP, the capacitor C may be initialized or discharged based on the initialization voltage VINIT having the high level applied to the first electrode and the first power supply voltage ELVDD applied to the second electrode.

In addition, during the initialization period INIP, the first power supply voltage ELVDD may be applied to the anode of the OLED through the turned-on sixth transistor T6, and the second power supply voltage ELVSS higher than or equal to the first power supply voltage ELVDD may be applied to the cathode of the OLED. Accordingly, during the initialization period INIP, the OLED may be initialized based on the first power supply voltage ELVDD applied to the anode. For example, the parasitic capacitor COLED of the OLED may be discharged.

As described above, in the pixel PX of the OLED display device according to example embodiments, the second transistor T2 may be initialized based on the first power supply voltage ELVDD applied through the sixth, fifth and third transistors T6, T5 and T3; thus, no additional gate initialization transistor, additional wiring for an initialization control signal, or additional writing for connecting the gate initialization transistor to an initialization voltage terminal may be required. Accordingly, the size of the pixel PX of the OLED display device may be minimized, and the resolution of the OLED display device may be maximized.

At an end time point of the initialization period INIP, the scan signals SCAN[ ], SCAN[ ] and SCAN[N] may be increased to a high level, and the first, third and sixth transistors T1, T3 and T6 included in each pixel PX may be turned off. Subsequently (or simultaneously), the initialization voltage VINIT may be decreased from a high level to a low level (i.e., an after-initialization level/voltage).

As illustrated in FIG. 3B, while the scan signal SCAN has the high level, the first, third and sixth transistors T1, T3 and T6 may be turned off, and the first power supply voltage ELVDD may not be provided to the gate of the second transistor T2. Subsequently (or simultaneously), when the initialization voltage VINIT connected to the first electrode of the capacitor C is decreased from the high level to the low level, a voltage of a node N1 connected to the second electrode of the capacitor C (or a voltage of a node connected to the gate of the second transistor T2) also may be decreased. The voltage of the node N1 may be decreased to the low level that is a sufficiently low to write the data voltage. For example, the low level of the voltage of the node N1 may be lower than the voltage corresponding to the absolute value of the threshold voltage of the second transistor T2 subtracted from the data voltage. Accordingly, during the data writing period DWP, the data voltage may be normally written to the pixel PX. For example, as illustrated in FIG. 4, during the initialization period INIP, the scan signal SCAN has a low level, and the voltage V_N1 of the node N1 may be the first power supply voltage ELVDD. The scan signal SCAN may be increased to a high level at the end time point of the initialization period INIP, and the initialization voltage VINIT may be decreased to a high level to a low level at a predetermined time point TL after the initialization period INIP. Accordingly, the voltage V_N1 of the node N1 may be decreased to a voltage VL that is sufficiently low to write the data voltage to the pixel PX.

During the data writing period DWP, the scan signals SCAN[ ], SCAN[ ] and SCAN[N] may be sequentially applied to the pixels on a scan line by scan line basis, and the emission control signals EM[1], EM[2] and EM[N] may be sequentially deactivated on the scan line by scan line basis such that, while each scan signal SCAN[ ], SCAN[ ] and SCAN[N] is applied to the pixels connected to a corresponding scan line, the fourth and fifth transistors T4 and T5 of the pixels connected to the corresponding scan line are turned off. For example, as illustrated in FIG. 2, each emission control signal EM[1], EM[2] and EM[N] may be activated before a corresponding scan signal SCAN[ ], SCAN[ ] and SCAN[N] is activated, and may be deactivated after the corresponding scan signal SCAN[ ], SCAN[ ] and SCAN[N] is deactivated.

As illustrated in FIG. 3C, during the data writing period DWP, the fourth and fifth transistors T4 and T5 may be turned off in response to the emission control signal EM having the high level. Further, during the data writing period DWP, the first, third and sixth transistors T1, T3 and T6 may be turned on in response to the scan signal SCAN having the low level. The second transistor T2 may be diode-connected by the turned-on third transistor T3. The data voltage VDATA may be provided to the data line, and the data voltage VDATA may be transferred to the node N1 connected to the second electrode of the capacitor C through the first transistor T1 and the diode-connected second transistor T2. Since the data voltage VDATA is transferred through the diode-connected second transistor T2, the voltage of the node N1 may become the voltage corresponding to the absolute value of the threshold voltage of the second transistor T2 subtracted from the data voltage VDATA. Thereafter, during the emission period EMP, the second transistor T2 may be driven based on the voltage corresponding to the absolute value of the threshold voltage subtracted from the data voltage VDATA, and thus a threshold voltage deviation between the second transistors T2 of the pixels PX included in the OLED display device may be compensated.

The second power supply voltage ELVSS may be decreased to the low level, and thus the emission period EMP may be initiated. During the emission period EMP, the pixels PX included in the OLED display device may substantially simultaneously emit light.

As illustrated in FIG. 3D, during the emission period EMP, the fourth and fifth transistors T4 and T5 may be turned on in response to the emission control signal EM having the low level, and the second power supply voltage ELVSS may be decreased to the voltage level lower than the voltage level of the first power supply voltage ELVDD. Thus, a current path from the first power supply voltage ELVDD through the second transistor T2 and the OLED to the second power supply voltage ELVSS may be formed. The second transistor T2 may generate a driving current IDR based on the voltage (e.g., the voltage corresponding to the absolute value of the threshold voltage of the second transistor T2 subtracted from the data voltage VDATA), and the OLED may emit light based on the driving current IDR.

Figure 5:
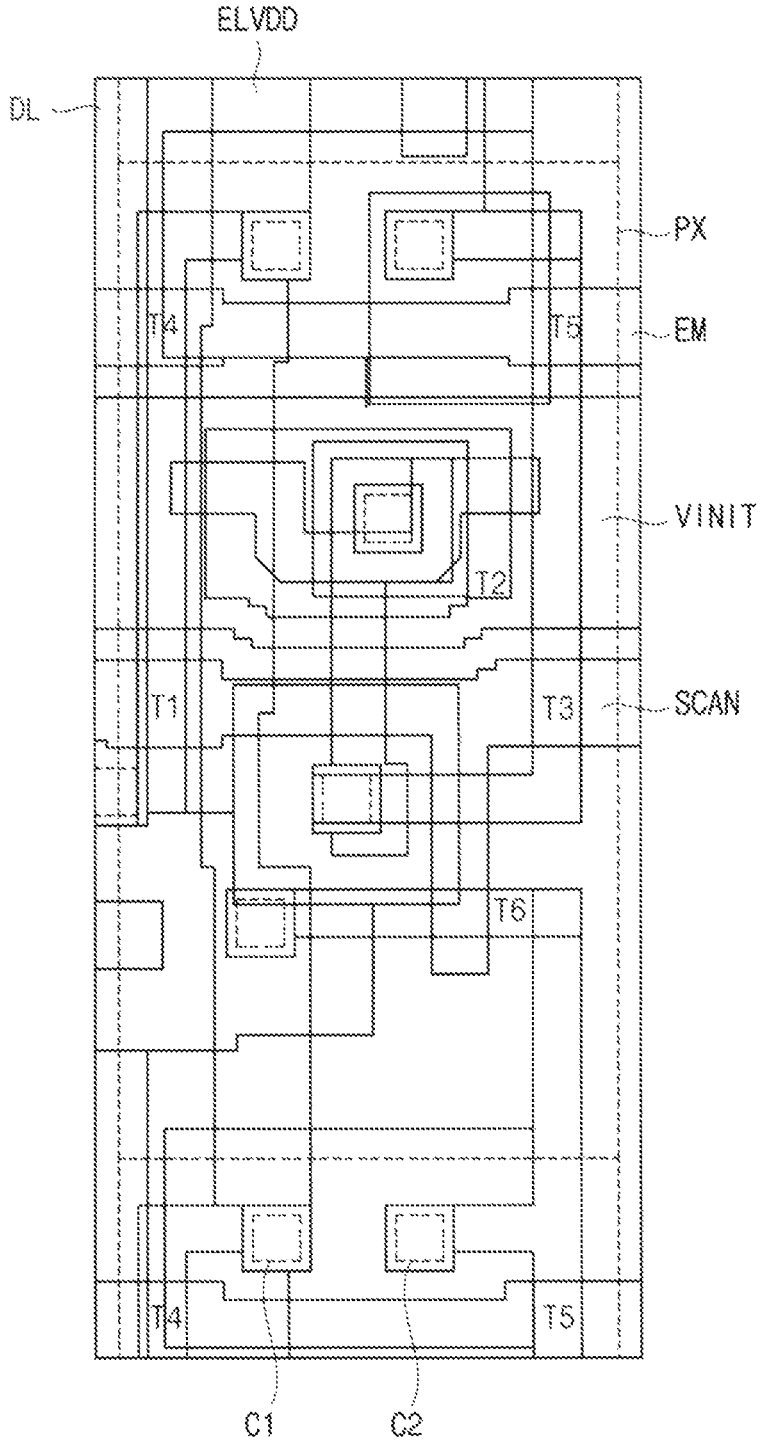
FIG. 5 is a diagram illustrating an example of a layout of a pixel of a display device, e.g., an OLED display device, according to example embodiments.

FIG. 5 is a diagram illustrating an example of a layout of a pixel of a display device, e.g., an OLED display device, according to example embodiments.

Referring to FIG. 5, each pixel PX of an OLED display device may include first through sixth transistors T1, T2, T3, T4, T5 and T6. Gates of the first, third and sixth transistors T1, T3 and T6 may be connected to a writing of a scan signal SCAN extending in a horizontal direction (or a width direction of the pixel PX), and gates of the fourth and fifth transistors T4 and T5 may be connected to a wiring of an emission control signal EM extending in the horizontal direction (or the width direction of the pixel PX). A first terminal of the first transistor T1 may be connected to a data line DL extending in a vertical direction (or a length direction of the pixel PX). A first terminal of the fourth transistor T4 and a second terminal of the sixth transistor T6 may be connected to a wiring of a first power supply voltage ELVDD extending in the vertical direction (or the length direction of the pixel PX). In some example embodiments, a first contact C1 connecting the first terminal of the fourth transistor T4 and the wiring of the first power supply voltage ELVDD and a second contact C2 connecting the second terminal of the fifth transistor T5 and an anode of an OLED may be disposed in the width direction of the pixel PX. The gate of the second transistor T2 may be connected to a wiring of an initialization voltage VINIT extending in the horizontal direction (or the width direction of the pixel PX) through a capacitor. In an OLED display device, the wiring of the first power supply voltage ELVDD may include not only wirings extending in the vertical direction but also wirings extending in the horizontal direction. In some example embodiments, conductive wirings extending in the horizontal direction may be used as the wiring of the initialization voltage VINIT in the OLED display device according to example embodiments.

To initialize the second transistor T2, an OLED display device may include an extra wiring for applying an initialization voltage to a gate of the second transistor T2, a gate initialization transistor connected between the wiring of the initialization voltage and the gate of the second transistor T2, and an extra wiring for applying an initialization control signal to a gate of the gate initialization transistor. However, the OLED display device according to example embodiments may not include the extra wirings or the gate initialization transistor. Accordingly, each pixel PX may have a small size, and resolution of the OLED display device may be increased.

Figure 6:
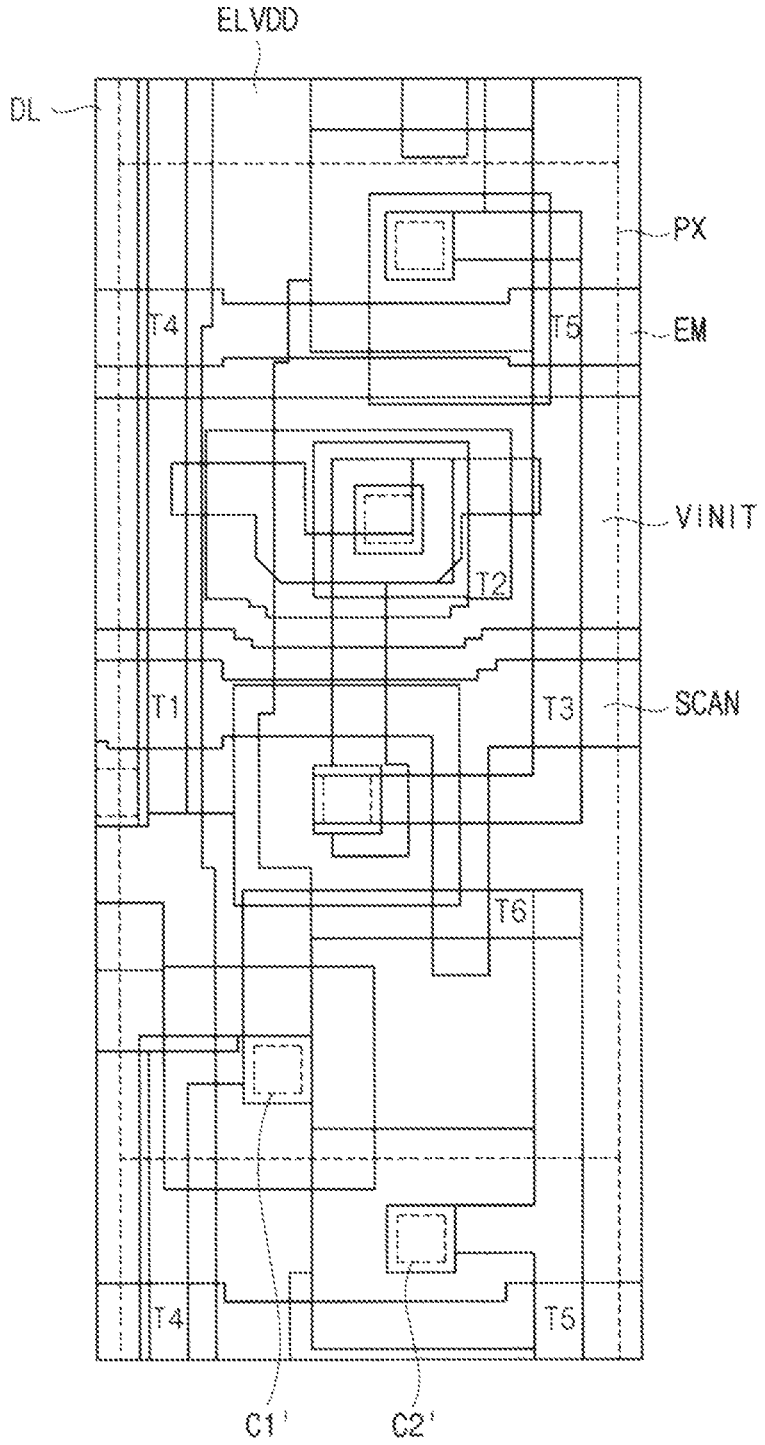
FIG. 6 is a diagram illustrating an example of a layout of a pixel of a display device, e.g., an OLED display device, according to example embodiments.

FIG. 6 is a diagram illustrating an example of a layout of a pixel of a display device, e.g., an OLED display device, according to example embodiments.

Referring to FIG. 6, each pixel PX of an OLED display device may include first through sixth transistors T1, T2, T3, T4, T5 and T6. A layout of the pixel PX illustrated in FIG. 6 may be similar to a layout of a pixel PX illustrated in FIG. 5, except for an structure of first and second contacts C1' and C2'.

In the pixel PX of FIG. 6, the first contact C1' (directly connecting a first terminal of a fourth transistor T4 and a wiring of a first power supply voltage ELVDD) and the second contact C2' (directly connecting a second terminal of a fifth transistor T5 and an anode of an OLED) may be structured and aligned such that, in a layout view, a virtual line connecting the center point of the first contact C1' and the center point of the second contact C2' is inclined (i.e., at an acute angle) with respect to a width direction of the pixel PX of FIG. 6 and/or with respect to a wire section of the wiring for transmitting the first power supply voltage ELVDD. Since the first contact C1' and the second contact C2' a structured such that the virtual line connecting the first and second contacts C1' and C2' is inclined with respect to the width direction of the pixel PX of FIG. 6, the pixel PX of FIG. 6 may have a narrower width than the pixel PX of FIG. 5 (where a line connecting the centers of the first and second contacts C1 and C2 extends in the width direction of the pixel PX). Accordingly, the pixel PX may have an even smaller size, and the resolution of the OLED display device may be further increased.

Figure 7:
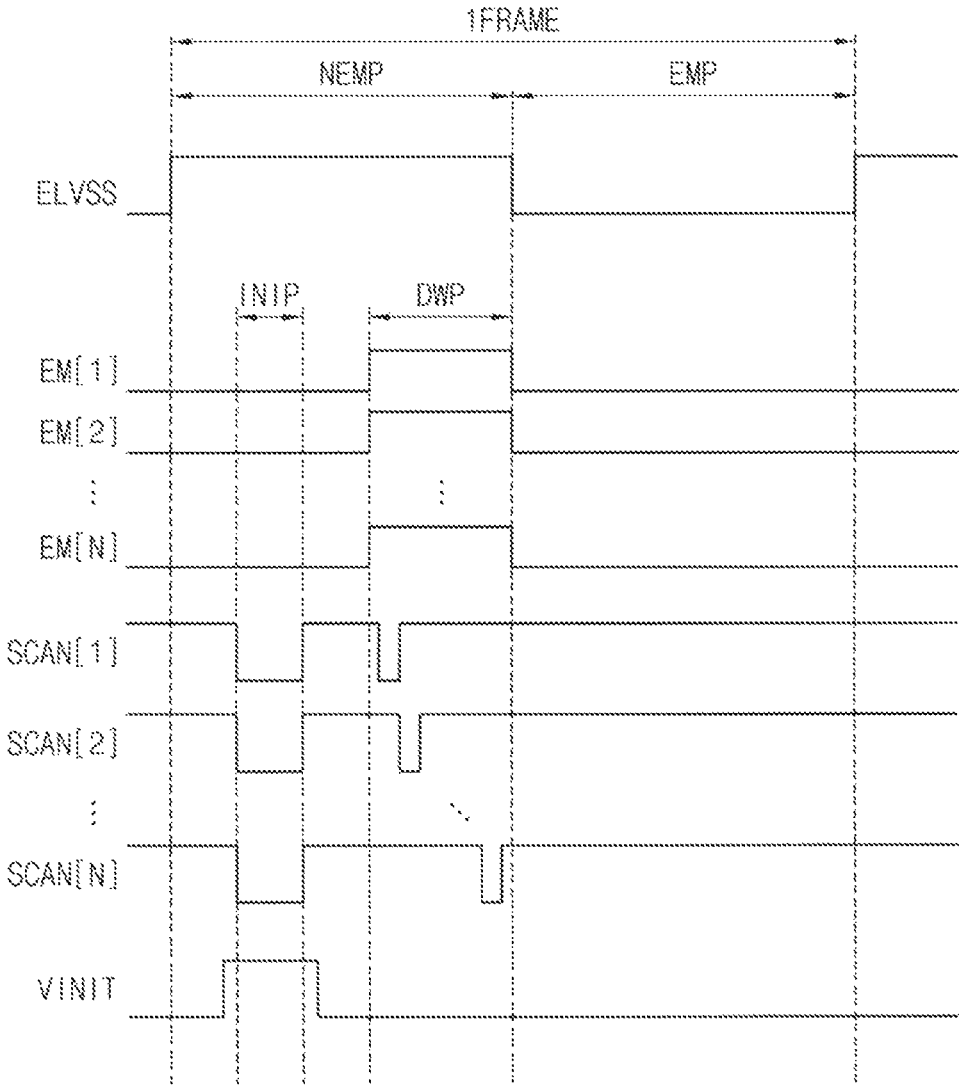
FIG. 7 is a timing diagram for illustrating an operation method of a pixel of a display device, e.g., an OLED display device, according to example embodiments.

FIG. 7 is a timing diagram for illustrating an operation method of a pixel of a display device, e.g., an OLED display device, according to example embodiments.

The timing diagram of FIG. 7 may be similar to a timing diagram of FIG. 2, except for emission control signals EM[1], EM[2] and EM[N] during a data writing period DWP. Thus, an operation of an OLED display device corresponding to the timing diagram of FIG. 7 may be similar to an operation described above with reference to FIG. 2, except for the operation during the data writing period DWP. During data writing period DWP, scan signals SCAN[ ], SCAN[2] and SCAN[N] may be sequentially applied to pixels of the OLED display device on a scan line by scan line basis, and the emission control signals EM[1], EM[2] and EM[N] may be deactivated substantially simultaneously with respect to all pixels. That is, the emission control signals EM[1], EM[2] and EM[N] may be a global signal that is simultaneously applied to the all pixels.

Figure 8:
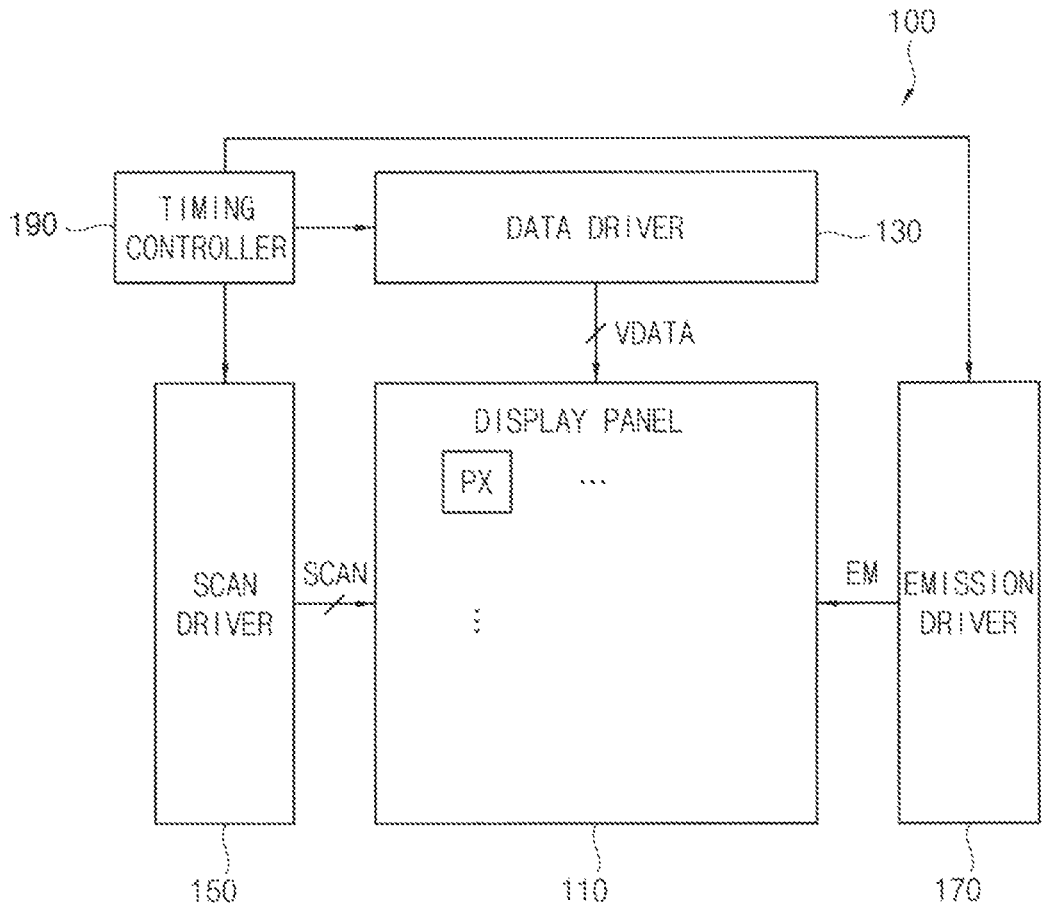
FIG. 8 is a block diagram illustrating a display device, e.g., an OLED display device, according to example embodiments.

FIG. 8 is a block diagram illustrating a display device, e.g., an OLED display device, according to example embodiments.

Referring to FIG. 8, an OLED display device 100 may include a display panel 110 including a plurality of pixels PX, a data driver 130 that provides a data voltage VDATA to the pixels PX, a scan driver 150 that provides a scan signal SCAN to the pixels PX, an emission control driver 170 that provides an emission control signal EM to the pixels PX, and a timing controller 190 that controls the data driver 130, the scan driver 150 and the emission control driver 170.

In the OLED display device 100, a driving transistor of each pixel PX may be initialized by applying a power supply voltage to a gate of the driving transistor through transistors that are turned on in response to the scan signal SCAN and the emission control signal EM. Thus, each pixel PX of the OLED display device 100 may be implemented without a gate initialization transistor connected between the gate of the driving transistor and an initialization voltage, a wiring of the initialization voltage connected to a terminal of the gate initialization transistor, and a wiring of an initialization control signal connected to a gate of the gate initialization transistor. Accordingly, the pixel PX of the OLED display device 100 may have a small size, and the OLED display device 100 may have a high resolution or high pixels per inch (PPI).

Figure 9:
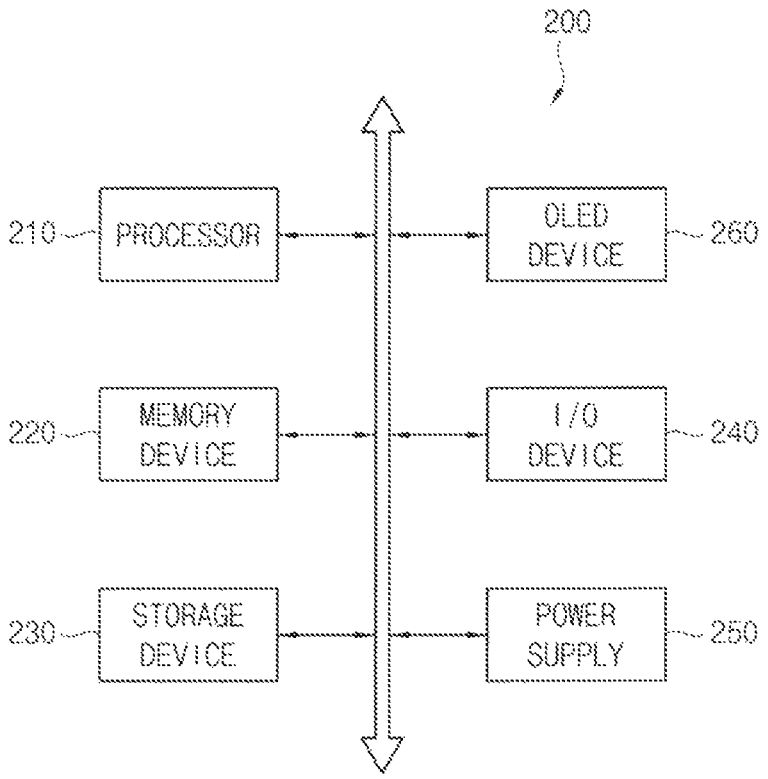
FIG. 9 is a block diagram illustrating an example of an electronic device according to example embodiments.

FIG. 9 is a block diagram illustrating an example of an electronic device according to example embodiments.

Referring to FIG. 9, an electronic device 200 may include a processor 210, a memory device 220, a storage device 230, an input/output (I/O) device 240, a power supply 250, and an OLED display device 260. The electronic device 200 may further include a plurality of ports for communicating a video card, a sound card, a memory card, a universal serial bus (USB) device, other electric devices, etc.

The processor 210 may perform various computing functions. The processor 210 may be an application processor (AP), a microprocessor, a central processing unit (CPU), etc. The processor 210 may be coupled to other components via an address bus, a control bus, a data bus, etc. Further, in some example embodiments, the processor 210 may be further coupled to an extended bus such as a peripheral component interconnection (PCI) bus.

The memory device 220 may store data for operations of the electronic device 200. For example, the memory device 220 may include at least one non-volatile memory device such as at least one of an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as at least one of a dynamic random access memory (DRAM) device, a static random access memory (SRAM) device, a mobile dynamic random access memory (mobile DRAM) device, etc.

The storage device 230 may be one of a solid state drive device, a hard disk drive device, a CD-ROM device, etc. The I/O device 240 may be an input device such as one of a keyboard, a keypad, a mouse, a touch screen, etc., and an output device such as one of a printer, a speaker, etc. The power supply 250 may supply power for operations of the electronic device 200.

In the OLED display device 200, a driving transistor of each pixel may be initialized by applying a power supply voltage to a gate of the driving transistor through transistors that are turned on in response to a scan signal and an emission control signal. Accordingly, the pixel of the OLED display device 200 may have a small size, and the OLED display device 200 may have a high resolution or high pixels per inch (PPI).

According to example embodiments, the electronic device 200 may be an electronic device including the OLED display device 260, such as one of a cellular phone, a smart phone, a tablet computer, a wearable device, a personal digital assistant (PDA), a portable multimedia player (PMP), a digital camera, a music player, a portable game console, a navigation system, a digital television, a 3D television, a personal computer (PC), a home appliance, a laptop computer, etc.

The foregoing is illustrative of example embodiments and is not to be construed as limiting thereof. Although a few example embodiments have been described, those skilled in the art will readily appreciate that many modifications are possible in the example embodiments. All such modifications are intended to be included within the scope defined in the claims.

What is claimed is:

1. A pixel comprising:

a light emitting element;

a first power supply terminal set configured to receive a first power supply voltage;

an initialization terminal electrically insulated from the first power supply terminal and configured to receive an initialization voltage;

a capacitor electrically connected through no intervening transistor to the initialization terminal; and a plurality of transistors comprising a first transistor, a second transistor, a third transistor, a fourth transistor, a fifth transistor, and a sixth transistor, wherein the first power supply terminal set is electrically connected through no intervening transistor to each of the fourth transistor and the sixth transistor, wherein the capacitor is electrically connected through no intervening transistor to the third transistor, wherein the first transistor and the fourth transistor are electrically connected through no intervening transistor to a same terminal of the second transistor, wherein each of the second transistor and the third transistor is electrically connected through no intervening transistor to the fifth transistor, and wherein each of the fifth transistor and the sixth transistor is electrically connected through no intervening transistor to the light emitting element.

2. The pixel of claim 1, wherein the capacitor is electrically insulated from the first power supply terminal set.

3. The pixel of claim 1, wherein the capacitor is electrically connected through no intervening transistor to a drain terminal of the third transistor or a source terminal of the third transistor.

4. The pixel of claim 1, wherein the capacitor is electrically connected through no intervening transistor to a gate terminal of the second transistor.

5. The pixel of claim 1, wherein a source terminal of the sixth transistor is electrically connected through no intervening transistor to a source terminal of the fourth transistor.

6. The pixel of claim 1, wherein the first power supply terminal set is electrically connected through no intervening transistor to each of a source terminal of the sixth transistor and a source terminal of the fourth transistor.

7. The pixel of claim 1, wherein the first power supply terminal set comprises a first supply terminal and a second supply terminal, wherein the first supply terminal is configured to receive the first power supply voltage and is electrically connected through no intervening transistor to a source terminal of the sixth transistor, and wherein the second supply terminal is configured to receive the first power supply voltage and is electrically connected through no intervening transistor to a source terminal of the fourth transistor.

8. The pixel of claim 1, wherein the first power supply terminal set is electrically connected through the sixth transistor, subsequently the fifth transistor, and subsequently the third transistor with no other intervening transistor to a gate terminal of the second transistor.

9. The pixel of claim 1 comprising: a first power supply wire section configured to transmit the first power supply voltage, wherein the fourth transistor comprises a first contact portion, wherein the first contact portion directly contacts the first power supply terminal set or the first power supply wire section, wherein the fifth transistor comprises a second contact portion, wherein the second contact portion directly contacts the light emitting element, and wherein a center point of the first contact portion is aligned with a center point of the second contact portion in a direction that is inclined with respect to the first power supply wire section.

10. A display device comprising:

a data line configured to transmit a data voltage;

a scan line configured to transmit a scan signal; and a pixel comprising a light emitting element, a first power supply terminal set, a first transistor, a second transistor, a third transistor, a fourth transistor, a fifth transistor, and a sixth transistor, wherein the data line is electrically connected through no intervening transistor to the first transistor, wherein the scan line is electrically connected through no intervening transistor to each of a gate terminal of the first transistor, a gate terminal of the third transistor, and a gate terminal of the sixth transistor, wherein the first power supply terminal set is configured to receive a first power supply voltage and is electrically connected through no intervening transistor to each of the fourth transistor and the sixth transistor, wherein the first transistor and the fourth transistor are electrically connected through no intervening transistor to a same terminal of the second transistor, wherein each of the second transistor and the third transistor is electrically connected through no intervening transistor to the fifth transistor, and wherein each of the fifth transistor and the sixth transistor is electrically connected through no intervening transistor to the light emitting element.

11. The display device of claim 10, wherein the pixel comprises an initialization terminal and a capacitor, wherein the initialization terminal is electrically insulated from the first power supply terminal set, is configured to receive an initialization voltage, and is electrically connected through no intervening transistor to a first electrode of the capacitor, and wherein a second electrode of the capacitor is electrically connected through no intervening transistor to a gate terminal of the second transistor.

12. The display device of claim 10, wherein the first power supply terminal set is electrically connected through the sixth transistor, subsequently the fifth transistor, and subsequently the third transistor with no other intervening transistor to a gate terminal of the second transistor.

13. A method of operating a pixel, the pixel comprising a light emitting element, a first transistor, a second transistor, a third transistor, a fourth transistor, a fifth transistor, and a sixth transistor, the method comprising:

in an initialization period, providing a first power supply voltage through the sixth transistor, subsequently the fifth transistor, and subsequently the third transistor to a gate terminal of the second transistor, wherein each of the first transistor and the fourth transistor is electrically connected through no intervening transistor to the second transistor, wherein each of the second transistor and the third transistor is electrically connected through no intervening transistor to the fifth transistor, and wherein each of the fifth transistor and the sixth transistor is electrically connected through no intervening transistor to the light emitting element.

14. The method of claim 13 comprising:

in the initialization period, providing the first power supply voltage through the sixth transistor to an anode of the light emitting element.

15. The method of claim 14 comprising:

in the initialization period, providing a second power supply voltage to a cathode of the light emitting element, wherein the second power supply voltage is higher than or equal to the first power supply voltage.

16. The method of claim 13 comprising:

in the initialization period, providing an initialization voltage to a first electrode of a capacitor, wherein a second electrode of the capacitor is electrically connected through no intervening transistor to the gate terminal of the second transistor; and after the initialization period, providing an after-initialization voltage to the first electrode of the capacitor, wherein the after-initialization voltage is lower than the initialization voltage.

17. The method of claim 16 comprising:

in the initialization period, providing the first power supply voltage through no capacitor part to the second electrode of the capacitor.

18. The method of claim 16 comprising:

in the initialization period, providing the first power supply voltage through the sixth transistor, subsequently the fifth transistor, and subsequently the third transistor to the second electrode of the capacitor.

19. The method of claim 16 comprising:

after the initialization period, turning off both the third transistor and the sixth transistor.

20. The method of claim 13 comprising:

in an initialization period, providing the first power supply voltage to both the gate terminal of the second transistor and a source terminal of the fourth transistor.

* * * * *